United States Patent [19]

Saffran

[11] Patent Number: 4,961,226

[45] Date of Patent: Oct. 2, 1990

[54] STEREO ELECTROACOUSTICAL TRANSDUCING

[75] Inventor: Richard E. Saffran, Boston, Mass.

[73] Assignee: Bose Corporation, Framingham, Mass.

[21] Appl. No.: 126,624

[22] Filed: Nov. 30, 1987

[51] Int. Cl.[5] ..... H04R 5/02

[52] U.S. Cl. ..... 381/24

[58] Field of Search ..... 381/24, 1

[56] References Cited

U.S. PATENT DOCUMENTS

| | | | |
|---|---|---|---|
| 3,588,355 | 6/1971 | Holm | 381/24 |
| 3,983,333 | 9/1976 | Allison | 181/144 |
| 4,051,919 | 10/1977 | Buettner | 381/24 |
| 4,256,922 | 3/1981 | Gorike | 381/24 |
| 4,266,092 | 5/1981 | Barker, III | 381/24 |
| 4,578,809 | 3/1986 | Eberbach | 381/24 |

OTHER PUBLICATIONS

Brociner, "The Trimensional Stereo Speaker System", Audio, Jun. 1959, pp. 21–24.

*Primary Examiner*—Forester W. Isen
*Attorney, Agent, or Firm*—Fish & Richardson

[57] ABSTRACT

A stereo loudspeaker system has left and right cabinets that are the mirror image of each other. Each cabinet has a rear panel perpendicular to a side panel and an angled panel that forms an acute angle with the side and rear panels. The side panel carries a first woofer. The angled panel carries a second woofer and a tweeter. The rear panel is clear of drivers. The woofers and tweeter are connected in phase. An RC circuit connects the input terminals to the tweeter. The woofers are connected in parallel across the input terminals.

17 Claims, 3 Drawing Sheets

STEREO ELECTROACOUSTICAL TRANSDUCING

The present invention relates in general to stereo electroacoustical transducing and more particularly concerns a novel stereo loudspeaker system characterized by high performance in providing both direct and reflected sound to simulate in a home the sound performance of a concert hall characterized by the commercially available BOSE 901, 601, 501, 301 and 201 loudspeaker systems and the structures disclosed in U.S. Pat. Nos. 2,915,588, 3,038,964, 3,582,553, 3,727,004, 4,266,092 and 4,621,708 while providing good stereo definition over a large listening area embodied in the commercially available BOSE Point Two loudspeaker systems and the structures disclosed in U.S. patent application Ser. No. 06/840,021 filed Mar. 17, 1986, and occupying relatively little floor space with apparatus that is relatively inexpensive and positions drivers at good listening height.

It is an important object of this invention to provide an improved stereo electroacoustical transducing system.

According to the invention, there are left and right loudspeaker cabinets each having a set of loudspeaker drivers arranged to be the mirror image of each other. Each cabinet includes at least back, side and front vertical panels. The back and side panels are arranged to face front and side walls of a room, respectively, and are generally perpendicular to each other. The angled panel is arranged to face the listening area of the room and forms an acute angle with the back and side walls, preferably 45°. Each side panel carries a first woofer driver means for radiating acoustical energy to the side. Each angled panel carries a second woofer means for radiating acoustical energy into the listening area and tweeter means for radiating acoustical energy into the listening area having spectral components in a frequency range higher than the spectral components of energy radiated by the woofer means. Preferably the diagonal panel is connected to the back panel by an inside panel generally parallel to the side panel, and the angled panel is connected to the side panel by a front panel generally parallel to the back panel.

Numerous other features, objects and advantages of the invention will become apparent from the following specification when read in connection with the accompanying drawing in which.

Figure 1:
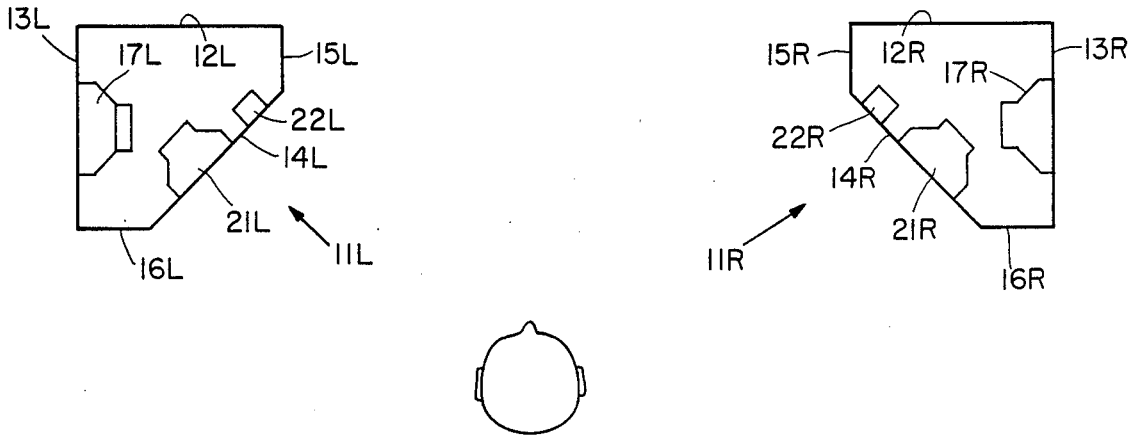
FIG. 1 is a pictorial plan view diagrammatically illustrating a system according to the invention.

With reference now to the drawing and more particularly FIG. 1 thereof, there is shown a plan view of a diagrammatic representation of a stereo electroacoustical transducing system according to the invention. The system includes a left loudspeaker cabinet 11L and a right loudspeaker cabinet 11R. Each cabinet includes a rear panel 12L, 12R, a side panel 13L, 13R and an angled panel 14L, 14R. The rear of each angled panel 14L, 14R is connected to a rear panel 12L, 12R by an inside panel 15L, 15R generally parallel to a side panel 13L, 13R. The front of each diagonal panel 14L, 14R is connected to a side panel 13L, 13R by a front panel 16L, 16R. Side panels 13L, 13R carry side woofers 17L, 17R. Angled panels 14L, 14R carry inside woofers 21L, 21R and rearward tweeters 22L, 22R.

Figure 2:
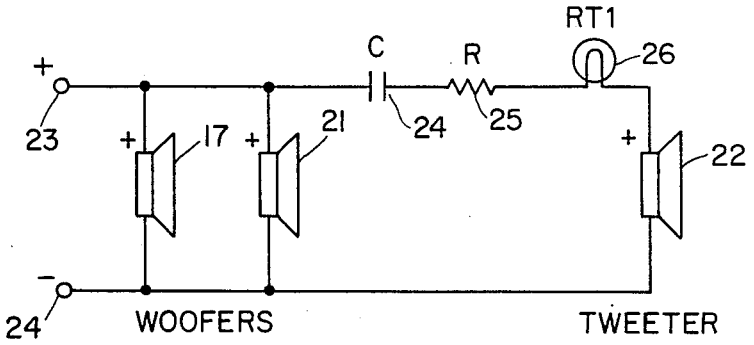
FIG. 2 is a schematic circuit diagram of a preferred means for interconnecting the three drivers in each cabinet.

Referring to FIG. 2, there is shown a schematic circuit diagram of a preferred arrangement for electrically interconnecting the woofers and tweeters. Woofers 17 and 21 are connected in parallel across input terminals 23 and 24. Capacitor 24, resistor 25 and light bulb 26 are connected in series between tweeter 22 and input terminal 23 so that tweeter 22 and woofers 17 and 21 are energized in phase.

Figure 3:
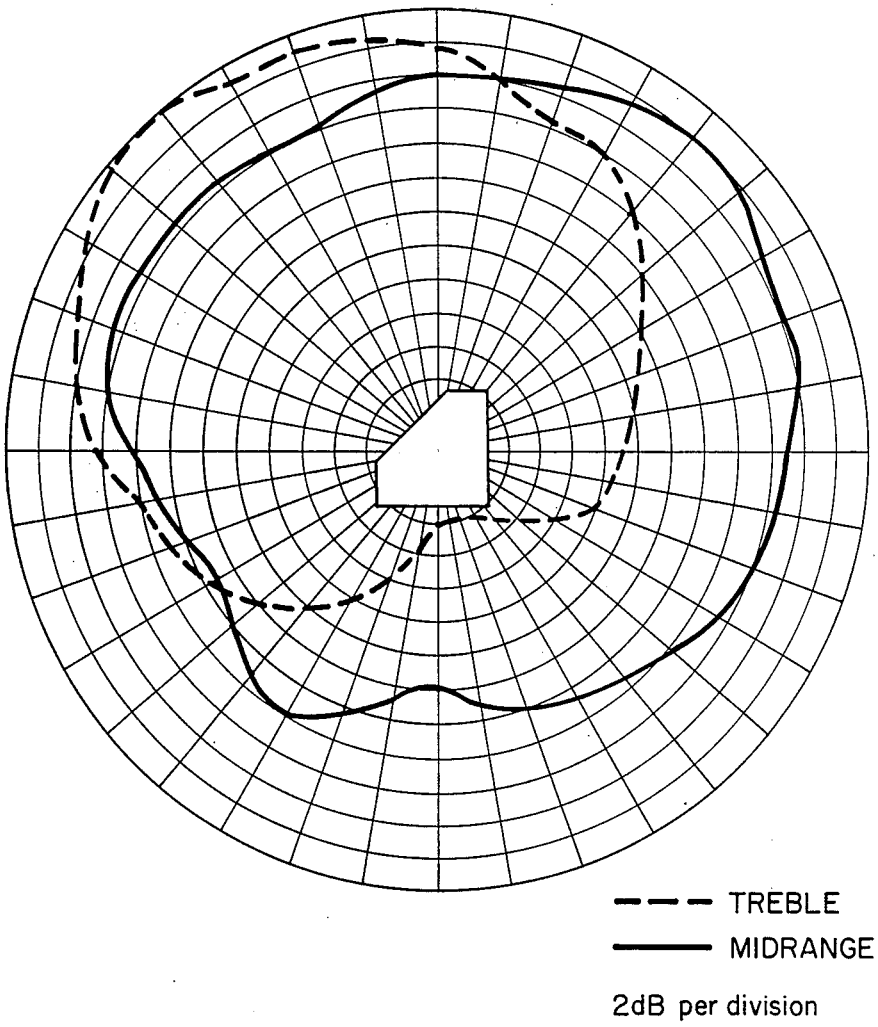
FIG. 3 is a polar pattern showing how the directivity pattern is steered so as to maximize the area over which a good stereo image is perceived and to maximize the listener's spatial impression.

Referring to FIG. 3, there is shown a polar pattern illustrating the directivity of each loudspeaker cabinet so that there is a maximum of directivity at treble and midrange frequencies along a direction perpendicular to an angled panel 14. Note also that there is significant energy radiated toward the side at the treble frequencies and toward the side and rear at the midrange frequencies for reflection from side and front walls to simulate the reflected sound present in a concert hall.

In an exemplary embodiment of the invention, woofers 17 and 21 are 6 ½" woofers, tweeter 22 is a 2" tweeter, the width of rear and side panels 12 and 13 is substantially 11.16", the width of inside and front panels 15 and 16 is substantially 3", and the angle formed by angled panel 14 with rear panel 12 and side panel 13 is substantially 45°. The height of each panel is substantially 30", and each of drivers 17, 21 and 22 is centered at substantially the same height substantially two feet above the floor.

Capacitor 24 is 5 microfarads, resistor 25 is 0.5 ohms and light bulb 26 is a modified light bulb that functions as a tweeter saver by increasing its resistance with increasing high frequency energy delivered to tweeter 22. The sound field in a concert hall is complex; however, research in a number of halls and in the laboratory indicates that a key element for spatial impression is early lateral reflections; those reflections which first follow the direct sound but arrive from the side. Four characteristics of the early lateral reflections are believed to affect the degree of spatial impression. They are timing, angle, level and spectrum. The first reflection should arrive from 8 to 80 milliseconds after the first arrival; earlier reflections only affect frequency response, while later arrivals become distinct echoes. Reflections from the sides produce the strongest spatial impressions; reflections from above and below, or front and back, have little effect. Increasing lateral reflection energy increases spatial impression. Lateral reflections from the bass up to about 3 kHz are most effective; low and midrange frequencies contribute a sense of envelopment, and lower treble frequencies contribute to perceived image width.

Because people's listening rooms at home are much smaller and acoustically different from concert halls, simply reproducing the radiation pattern of the original music source is not satisfactory. Other traditional approaches, such as dipoles or omnidirectional sources, are also unsuitable.

The present invention embodies establishing a set of radiation patterns, each defining what is believed to be the optimum distribution of sound over a particular range of frequencies. In the midrange the pattern has a maximum away from the area between the speakers and towards the side wall. This energy reflects from the side walls, reaching the listener some time after the first arrival of the direct sound and from the side. The level of this lateral reflection radiation lobe, relative to the first direct arrival lobe, is selected to produce a pleasing amount of spatial impression given the path delay in typical rooms, usually around 10 milliseconds.

In the upper part of the midrange the magnitude of the lateral reflection lobe decreases, tapering off significantly in the treble. In fact, at high frequencies, above 3 kHz, the desired radiation pattern reverses. The system directs maximum sound energy inwards between the cabinets If one listens to a centered (monophonic) sound while standing between two speakers, the listener hears identical sound from the left and right to perceive the sound coming from straight ahead. If the listener moves to the left, the sound from the left speaker arrives first, and with conventional direct-radiating speakers, the listener now perceives the sound coming from the left speaker, as if the right speaker were not even radiating. This perception is caused by the precedence effect; that is, the first high frequency sound arrival is used to determine direction. This effect can be counteracted by making the second arrival louder than the first. An inward angled radiation pattern at high frequencies achieves this counteraction. As the listener moves closer to one speaker, the listener also receives proportionally more energy from the other speaker, balancing image localization through a broad area.

The invention achieves these performance properties with quality sound in a pleasing and cost-effective package. In the lower part of the midrange (200 Hz to 1 kHz) the pair of woofers 17 and 21 in each cabinet coat to direct sound largely toward the listening area and to the sides. More energy goes toward side walls than towards the listener. This property is largely responsible for the sense of spaciousness and envelopment in the music provided by the invention.

In the upper part of the midrange (1 kHz to 3 kHz) woofers 17 and 21 are still active. The side firing woofers 17 direct sound towards the room side walls to provide a balance of lateral reflections that decreases with frequency. The inward angled woofers 21 provide the cross-firing lobes for maintaining a proper stereo image over a broad area.

Above 3 kHz tweeters 22 are largely responsible for maintaining the proper stereo image by extending the cross-firing radiation pattern to the upper limit of the tweeters.

The polar plot in FIG. 3 shows the distribution of sound around a cabinet in two broad frequency ranges: midrange and treble. The two patterns are distinctly different as indicated above to take advantage of the different properties of sound perception; angled inward at high frequencies and outward at lower frequencies.

Figure 4:
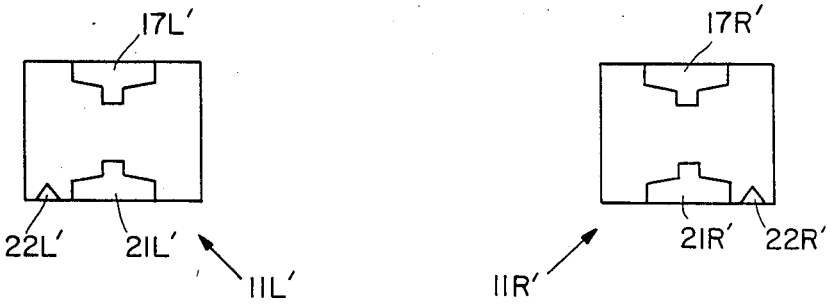
FIG. 4 is a pictorial plan view diagrammatically illustrating another embodiment of a system according to the invention.

The invention is embodied in the commercially available BOSE 401 loudspeaker system incorporated herein by reference. While that loudspeaker system is a preferred embodiment of the invention, other embodiments may be characterized by features of the invention. For example, one embodiment of the invention characterized by a desired radiation pattern for desired spatial impression may comprise a rectangular enclosure having a first woofer on the front panel and a second woofer on the rear panel with a tweeter also located on the front panel, preferably to the side of the front panel woofer as shown in FIG. 4. This embodiment includes a left loudspeaker cabinet 11L' and a right loudspeaker cabinet 11R'. Each cabinet includes a front woofer 21L', 21R', a rear woofer 17L', 17R' and a front tweeter 22L', 22R'.

The distance between the rear and front panels is preferably approximately ½ wavelength at midrange frequencies, typically a distance between 1 foot and 2.5 feet.

Figure 5A:
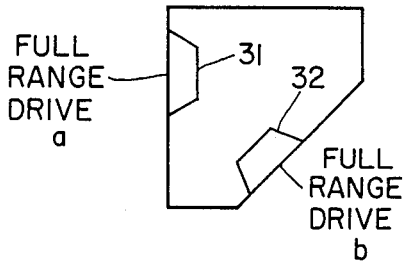
FIG. 5A is a pictorial plan view diagrammatically illustrating another embodiment of a system according to the invention using full range drivers.
Figure 5B:
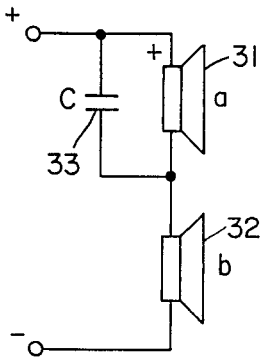
FIG. 5B is a schematic circuit diagram showing the preferred means for interconnecting the full range drivers of FIG. 5.

Referring to FIG. 5A, there is shown a pictorial plan view diagrammatically illustrating another embodiment of a system according to the invention using full range drivers. FIG. 5A illustrates the left enclosure. The right enclosure is nearly the mirror image of the left enclosure. This embodiment includes a full range driver 31 mounted on the side panel radiating toward the side wall and a second full range driver 32 mounted on the angled panel radiating into the listening area. FIG. 5B is a schematic circuit diagram of the interconnection of drivers 31 and 32. A capacitor 33 of value C shunts high frequency energy around driver 31 so that the radiation from driver 31 to the side is restricted essentially to spectral components in the upper midrange and below; that is, less than substantially 3 kHz.

Figure 6:
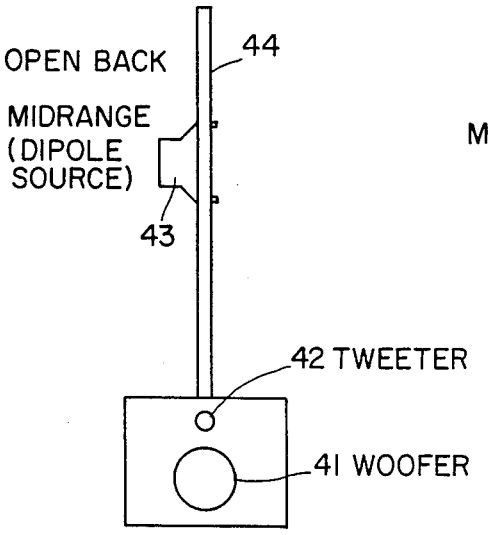
FIG. 6 is a pictorial front view diagrammatically illustrating another embodiment of the invention showing a midrange driver mounted with an open back.

Referring to FIG. 6, there is shown a pictorial front view diagrammatically illustrating an embodiment of the invention comprising a woofer 41 and tweeter 42 on the front panel and an open back midrange driver 43 mounted on a vertical baffle 44.

Figure 7:
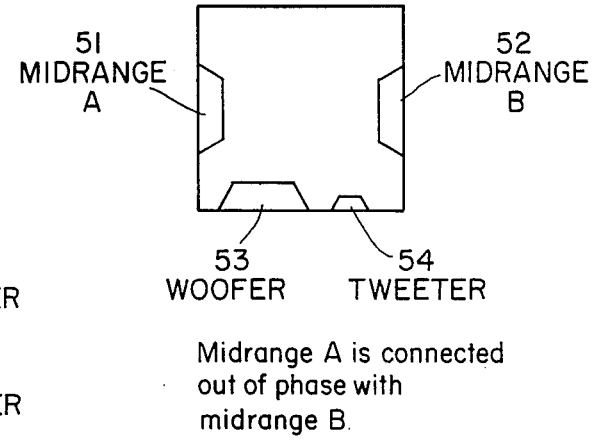
FIG. 7 is a pictorial plan view diagrammatically illustrating another embodiment of the invention with the midrange drivers on side panels energized in phase opposition.

Referring to FIG. 7, there is shown a pictorial plan view diagrammatically illustrating another embodiment of a system according to the invention comprising a pair of midrange drivers 51 and 52 mounted on side panels and energized in phase opposition. Woofer 53 and tweeter 54 are mounted on the front panel.

The left and right cabinets need not be exact mirror images in a stereo system according to the invention, although it is preferred that they be nearly mirror images.

It is convenient to define low frequency energy as energy having spectral components below approximately 100 Hz. This low frequency energy may be radiated by any means within the principles of the invention, including, but not limited to, the specific woofers described, an additional woofer located anywhere on or inside the cabinet, or by an additional woofer located in an additional third cabinet, such as embodied in the commercially available BOSE ACOUSTIMASS loudspeaker system.

It is convenient to define lower midrange energy as energy having spectral components within approximately 100 Hz to 1 kHz and may be radiated by the pair of woofers in a cabinet, such as in the embodiment of FIG. 1, by separate midrange drivers, such as in the embodiments of FIG. 6 or FIG. 7 or by full range drivers, such as in the embodiment of FIGS. 5A and 5B.

General aspects of the invention include means for radiating both midrange energy; that is energy with spectral components from approximately 100 Hz to approximately 3 kHz and treble energy having spectral components above approximately 3 kHz from a front panel normally facing the listening area while having means for radiating energy to the side normally toward a side wall in the listening area of energy with spectral components below about 3 kHz.

In summary, the invention provides spacious sound allowing the listener to feel enveloped in the music, a balanced stereo image throughout the room, ease of placement with each cabinet taking up only about a square foot of floor space and allowing positioning almost anywhere in the room, and high efficiency and power handling.

There has been described novel apparatus and techniques for reproducing stereo sound in small rooms while simulating the performance in a concert hall in a relatively compact package that is relatively inexpensive. It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Stereo electroacoustical transducing apparatus comprising, left and right loudspeaker cabinets each having an input terminal pair, each of said loudspeaker cabinets being substantially the mirror image of the other and having at least a rear panel and a side panel for normally facing front and side walls of a listening room and a front panel for normally facing the listening area of a room, for each of said loudspeaker cabinets one of said rear and side panels supporting a first woofer means for radiating low frequency energy and comprising first driver means for radiating acoustical energy having spectral components restricted to being below approximately 100 Hz to 3 Hz, each front panel supporting a second woofer means for radiating low frequency energy and a tweeter means for radiating high frequency energy, said second woofer means and said tweeter means comprising second driver means for radiating acoustical energy having spectral components in both the midrange from approximately 100 Hz to 3 kHz and in the treble frequency range having spectral components above 3 kHz, means for coupling said first woofer means and said second woofer means to said input terminal pair so that said first and second woofer means radiate acoustical energy in phase, and high pass filtering means for coupling said input terminal pair to said tweeter means so that acoustical energy radiated from said one of said side and rear panels is restricted to energy having spectral components below approximately 3 kHz while acoustical energy radiated from said front panel includes spectral components within the midrange from about 100 Hz to 3 kHz and in the treble frequency range above approximately 3 kHz, said first and second driver means, said front, rear and side panels and said high pass filtering means coacting to establish a radiation pattern having a maximum in the midrange away from the area between the left and right loudspeaker cabinets and toward an adjacent side wall and a maximum in the treble range directed toward said area between the left and right loudspeaker cabinets.

2. Stereo electroacoustical transducing apparatus in accordance with claim 1 wherein said first woofer means is the same as said second woofer means.

3. Stereo electroacoustical transducing apparatus in accordance with claim 1 wherein the angle between said front panel and said rear and side panels is substantially 45°.

4. Stereo electroacoustical transducing apparatus in accordance with claim 1 wherein said first and second woofer means coact in the lower part of the midrange frequency spectrum to direct sound largely forward and to the sides and in the upper part of the midrange of frequencies direct sound energy both toward the side and in cross firing.

5. Stereo electroacoustical transducing apparatus in accordance with claim 4 wherein above said midrange said tweeter means provide a cross-firing radiation pattern to the upper limit frequency of said loudspeaker system.

6. Stereo electroacoustical transducing apparatus in accordance with claim 1 wherein said front panel is an angled panel and said side panel supports said first woofer means.

7. Stereo electroacoustical transducing apparatus in accordance with claim 6 and further comprising means for connecting said woofer means and said tweeter means in phase.

8. Stereo electroacoustical transducing apparatus in accordance with claim 7 wherein said first woofer means is the same as said second woofer means.

9. Stereo electroacoustical transducing apparatus in accordance with claim 6 wherein the angle between said front panel and said rear and side panels is substantially 45°.

10. Stereo electroacoustical transducing apparatus in accordance with claim 6 wherein said first and second woofer means coact in the lower part of the mid-range frequency spectrum to direct sound largely forward and to the sides and in the upper part of the midrange of frequencies direct sound energy both toward the side and in cross firing.

11. Stereo electroacoustical transducing apparatus comprising, left and right loudspeaker cabinets each having an input terminal pair, each of said loudspeaker cabinets being substantially the mirror image of the other and having first and second woofer means for radiating sound energy into a room having at least front and side walls with a listening area between side walls facing the front wall, each of said loudspeaker cabinets having means for coupling said first and second woofer means to said input terminal pair so that said first and second woofer means radiate acoustical energy in phase characteristic of a common signal on said input terminal pair, and means for supporting and intercoupling said first and second woofer means for coaction in the lower part of the midrange frequency spectrum to direct sound energy largely to the listening area and to the walls with more energy directed away from than to said listening area in said lower part of the midrange frequency spectrum and in the upper part of the midrange of frequencies direct sound energy at least toward a side wall.

12. Stereo electroacoustical transducing apparatus in accordance with claim 11 wherein said means for supporting and intercoupling further establishes coaction between said first and second woofer means for directing sound energy in cross firing in the upper part of the midrange of frequencies.

13. Stereo electroacoustical transducing apparatus comprising:

left and right loudspeaker cabinets each having an input terminal pair, each of said loudspeaker cabinets being substantially the mirror image of the other and having at least a rear panel and a side panel for normally facing front and side walls of a listening room and a front panel for normally facing the listening area of a room, for each of said loudspeaker cabinets one of said rear and side panels supporting a first driver means for radiating low frequency acoustical energy having spectral components restricted to being below approximately 100 Hz to 3 kHz, each front panel supporting second driver means for radiating acoustical energy having spectral components in both the midrange from approximately 100 Hz to 3 kHz and in the treble frequency range having spectral components above 3 kHz, and means for coupling said input terminal pair to said first driver means and to said second driver means to that acoustical energy radiated to the side of each loudspeaker cabinet is restricted to energy having spectral components below approximately 3 kHz while acoustical energy radiated from said front panel includes spectral components within the midrange from about 100 Hz to 3 kHz and in the treble frequency range above approximately 3 kHz, said first and second driver means, said front, rear and side panels and said means for coupling coacting to establish a radiation pattern having a maximum in the midrange away from the area between the left and right loudspeaker cabinets and toward an adjacent side wall and a maximum in the treble range directed toward said area between the left and right loudspeaker cabinets.

14. Stereo electroacoustical transducing apparatus in accordance with claim 13 wherein said first driver means comprises a woofer mounted on said rear panel and said second driver means comprises a woofer and tweeter mounted on said front panel.

15. Stereo electroacoustical transducing apparatus in accordance with claim 13 wherein said first and second driver means each comprise a full range driver, and means for coupling said input terminal pair to said first and second driver means, said means for coupling including means for bypassing signals having spectral components above approximately 3 kHz across said first driver means.

16. Stereo electroacoustical transducing apparatus in accordance with claim 13 wherein said side panel comprises first and second side segments each forming a side of said cabinet and said first driver means comprises a midrange driver on each of said side sections, said second driver means comprising a woofer and tweeter on said front panel.

17. Stereo electroacoustical transducing apparatus in accordance with claim 13 wherein said first driver means comprises an open back midrange driver on said side panel, and said second driver means comprises a woofer and tweeter on said front panel.

* * * * *